United States Patent [19]

Kranert

[11] 4,007,407

[45] Feb. 8, 1977

[54] TURBO-ELECTRIC MARINE POWER PLANT AND METHOD OF REGULATING THE SAME

[75] Inventor: Klaus Kranert, Hamburg, Germany

[73] Assignee: Licentia Patent-Verwaltungs-G.m.b.H., Frankfurt am Main, Germany

[22] Filed: Oct. 24, 1974

[21] Appl. No.: 517,651

[30] Foreign Application Priority Data

Oct. 27, 1973 Germany ..... 2353974

[52] U.S. Cl. ..... 318/147; 290/40 C; 290/40 F; 290/52; 318/561

[51] Int. Cl.[2] ..... H02P 9/00

[58] Field of Search ..... 290/1 R, 2, 4, 10, 15, 290/11, 14, 40 R, 40 A–40 C, 40 E, 43, 51, 46, 52; 307/87; 318/145, 147, 463, 464, 465, 158, 561; 60/39.28 R

[56] References Cited

UNITED STATES PATENTS

| | | | |
|---|---|---|---|
| 2,011,655 | 8/1935 | Schaelchlin et al. | 318/147 X |
| 3,848,171 | 11/1974 | Speth et al. | 290/52 X |
| 3,892,978 | 7/1975 | Haley | 307/87 |

*Primary Examiner*—James R. Scott
*Attorney, Agent, or Firm*—Spencer & Kaye

[57] ABSTRACT

In a marine power plant which has an rpm-regulatable heavy gas turbine, a propulsion generator driven by the turbine, a propulsion motor driven by the generator and a fixed propeller driven by the motor, the turbine rpm is regulated as a function of the propeller rpm to obtain a delivered turbine output which lies above the minimum output limit of the turbine.

12 Claims, 4 Drawing Figures

TURBO-ELECTRIC MARINE POWER PLANT AND METHOD OF REGULATING THE SAME

BACKGROUND OF THE INVENTION

This invention relates to a turbo-electric marine power plant which includes a variable-speed heavy gas turbine, a synchronous propulsion generator coupled mechanically with the gas turbine and a synchronous or asynchronous propulsion motor coupled electrically with the propulsion generator. The propulsion motor drives a fixed propeller by means of a propeller shaft. The drive is effected by frequency regulation down to a minimum turbine rpm and by means of slip regulation below the minimum turbine rpm.

Turbo-electric marine power plants which have a heavy gas turbine as prime mover are known. In such a power plant the turbine is connected mechanically with the synchronous propulsion generator. The synchronous generator supplies current to the propulsion motor which may be of the synchronous or asynchronous type. In such an arrangement the propulsion generator and the propulsion motor constitute a drive substitute in the form of an "electric shaft". Since, on the one hand, the turbine runs continuously with the nominal rpm and is, on the other hand, not reversible, the propeller has to be of the adjustable type to make possible a change in the travelling speed of the ship and a reversal of the propelling force by virtue of changing the angular setting of the propeller blades. In this connection reference is made to the periodical SHIPBUILDING AND SHIPPING RECORD of Feb. 16, 1973 pages 15 – 19 entitled: "General Electric's Heavy Duty Gasturbine/Electric Propulsion System". It is a disadvantage of such an arrangement that the output is, for econimical consideration, limited to approximately 40,000 HP.

In another known embodiment of such power plant there is used a slip clutch in connection with a fixed propeller; thus, the travelling speed of the ship and the reversal of propulsion are controlled by means of the slip clutch.

SUMMARY OF THE INVENTION

It is an object of the invention to provide a turbo-electric marine power plant which, without the use of an adjustable propeller, or a slip clutch, may be reliably controlled in all phases of travel, which is simple and economical in construction and which may deliver high outputs as well.

This object and others to become apparent as the specification progresses, are achieved by the invention, according to which, briefly stated, in the marine power plant which has an rpm-regulatable heavy gas turbine, a propulsion generator driven by the turbine, a propulsion motor driven by the generator and a fixed propeller driven by the motor, the turbine rpm is regulated as a function of the propeller rpm to obtain a delivered turbine output which lies above the minimum output limit of the turbine. With this arrangement any rpm, from standstill up to an rpm corresponding to the minimum turbine rpm, is controlled by a propeller rpm-responsive voltage regulation affecting a slip drive.

The marine power plant designed according to the invention has the particular advantage that for all rpm's and travelling speeds it can be reliably controlled and it is adapted to deliver large outputs.

DESCRIPTION OF THE PREFERRED EMBODIMENTS

The marine power plant designed according to the invention includes a two-shaft, variable-speed heavy turbine as the prime mover. The rpm regulation of the turbine affects the propeller rpm. Thus, for example, an rpm increase of the turbine causes a frequency increase of the propulsion generator. By means of controlling the field current, the armature voltage of the generator is increased in such a manner that there is set a constant value for the ratio formed of the generator voltage and the generator frequency. This means that in case of full current supply for the propulsion motor, the propeller shaft is subjected to constant torques. This regulation applies to the upper and medium propulsion range down to the minimum rpm limit of the heavy gas turbine.

The minimum turbine rpm limit is approximately one third of the nominal rpm of the turbine, or 0.33 $n_{Tnom}$. If, the example, due to an overload, the turbine rpm falls below this limit, the gas turbine stalls. For this reason, the regulation of the propeller rpm is effected in the lower third of the propulsion range by means of the slip drive of the propulsion motor.

Figure 2:
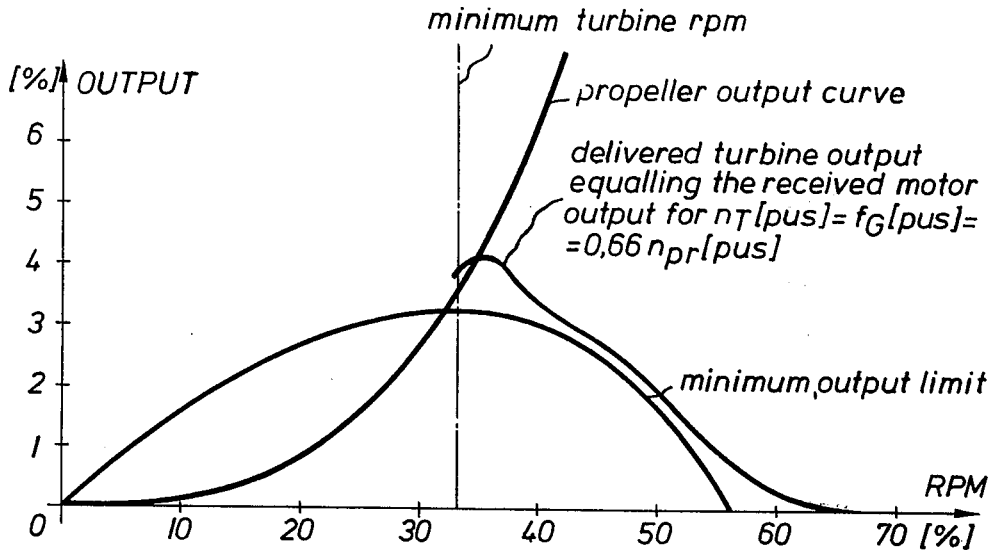
FIG. 2 is a diagram illustrating outputs as a function of the rpm.

For the propulsion drive two critical points have to be observed: first, the rotor slip losses should not significantly exceed the nominal rotor losses of the motor (FIG. 3) and, second, at the gas turbine certain rpm's can be set only if the delivered output is above the minimum output limit (FIG. 2).

In order to thus ensure that the rotor slip losses do not significantly exceed the nominal rotor losses, the propulsion ought to be effected with small turbine rpm's, the is, in the neighborhood of the minimum turbine rpm limit of, for example, $0.33n_{Tnom}$. A regulation to a constant turbine rpm of $0.33n_{Tnom}$ for driving the motor at slippage rpm's in the lower third of the propulsion range is, however, as indicated above, not possible because the turbine rpm would drift towards the point on the minimum output limit (of approximately $0.56n_{Tnom}$ to $0.33n_{Tnom}$), which, with regard to output, corresponds to the received motor output (which, in turn, equals the sum of the slippage loss and the delivered propeller output).

The non-regulated drifting of the turbine rpm leads, in case of load surges, to undesirable rpm fluctuations and since the minimum output limit does not appreciably vary in the range of approximately $0.3n_{Tnom}$ to $0.36n_{Tnom}$, a load surge results, in this range, in a substantial turbine rpm drop. Because of the high turbine time constants, this phenomenon may lead to a drop below the minimum rpm, since the rapid rpm variation can no longer be followed.

The above-discussed fluctuation of the turbine rpm's and a drop below the limit range can be avoided if the turbine rpm is controlled in such a manner as function of the propeller rpm that, on the one hand, the rotor slippage losses do not significantly exceed the nominal rotor losses of the motor and, on the other hand, the delivered turbine output is continuously above the minimum output limit. Thus, to begin with, a turbine rpm $n_{Tx}$ is selected which is higher than indicated by the minimum output curve and the turbine rpm is regulated as a function of the actual propeller rpm. For this situation the following relationship applies:

$$n_T = n_{Tx} - f[n_{prop.actual}].$$

In FIG. 2, there is an exemplary manner, selected a value of $0.66n_{Tnom}$ as the turbine output rpm. Thus, $$n_T\,[\text{pus}] = f_G\,[\text{pus}] = 0.66 - n_{prop}[\text{pus}].$$

[pus] stands for per units and means: values with reference to nominal values.

Figure 3:
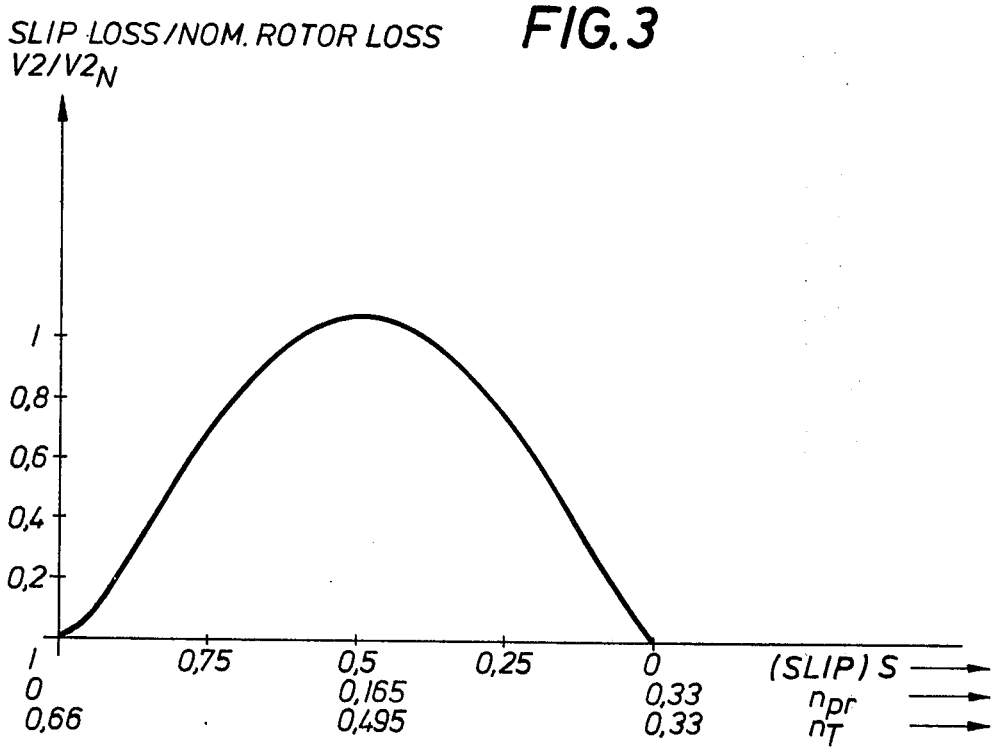
FIG. 3 is a diagram illustrating the ratio of slippage losses to nominal rotor losses as a function of the slippage.

It is thus seen that the delivered turbine output lies above the minimum output limit. If the desired value for the propeller rpm is fed slowly, the turbine rpm will be realigned without distrubance. FIG. 3 illustrates that in case of the above-described control of the turbine rpm, the rotor slippage losses do not significantly exceed the nominal rotor losses.

Figure 1:
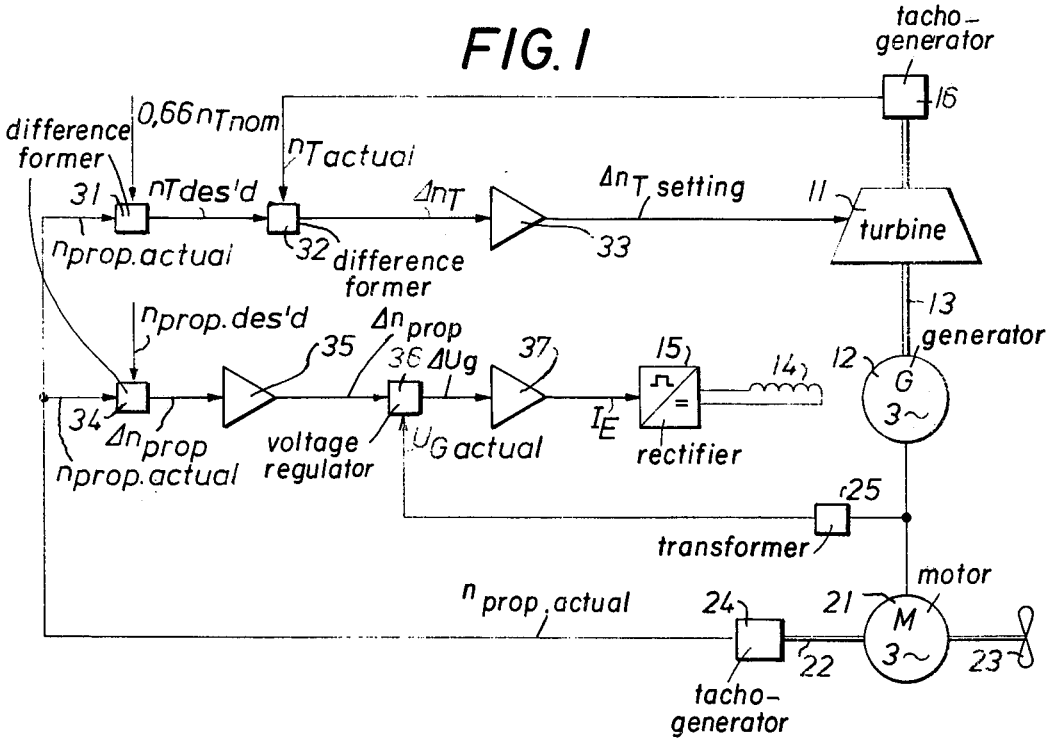
FIG. 1 is a block diagram of a preferred embodiment of a control circuit for the slip drive.

In the embodiment according to FIG. 1, there is shown a heavy gas turbine 11 which drives a synchronous propulsion generator 12 by means of a shaft 13. The turbine rpm is sensed by means of a tacho-generator 16. The propulsion generator 12 supplies current to a propulsion motor 21 which may be a synchronous or an asynchronous motor and which drives a fixed propeller 23 by means of a propeller shaft 22. The rpm of the shaft 22 is sensed by a tacho-generator 24.

The turbine output rpm of approximately $0.66n_{Tnom}$ (FIG. 2) is set at the regulator (difference former), 31 as a desired value. The rpm of the propeller $n_{prop}$ is used as an actual value. The signal $n_{Tdes,d}$ emitted by the regulator 31 represents the difference between the actual propeller rpm and $0.66n_{Tnom}$. This signal is applied to a regulator (difference former) 32 as the desired turbine rpm. The regulator 32 also receives a signal $n_{Tactual}$ from the tacho-generator 16, representing the acutal turbine rpm. From a comparision of these two signals there is obtained the regulating signal (that is, the deviation to be eliminated by the regulation) $\Delta n_T$ which is applied to a circuit 33. The latter, in turn, emits a setting signal (proportionate to the signal $\Delta n_T$) for altering the fuel supply of the turbine. This is effected in such a manner that with an increase of the actual propeller rpm the turbine rpm changes slowly towards a smaller rpm value from the value of $0.66n_{Tnom}$, but remains above the critical turbine output limit.

The calculation that follows illustrates this process. The propeller rpm is slowly increased from $n_{prop.actual}=0$ to, for example, $n_{prop.actual}=0.10$. As a result, at the regulator 31 there appears an actual signal value $n_{prop.acutal}=0.10$ with a fixed desired value input pf $0.66n_{Tnom}$. Consequently, the regulating signal slowly changes at the regulator output from 0.66 towards 0.56, corresponding to the changed actual value input. For the desired value input of the regulator 32 this means a slow drop. The signal appearing at the output of the regulator 32 is applied to the circuit 33, the setting signal $\Delta n_T$ of which now maintains the fuel supply of the turbine in such a manner that the turbine rpm changes slowly above the critical output limit in a regulated manner towards an rpm of, for example, $0.33n_{Tnom}$.

As it has been noted before, the propeller rpm is regulated by means of slippage of the propulsion motor. The actual propeller rpm is, simulataneously with its application to the regulator 31, applied to the propeller rpm regulator (difference former) 34 as an actual value; the desired value input $n_{prop.des,d}$ is communicated in most cases by engine order telegraph. The regulating signal $\Delta n_{prop}$ is applied to a circuit 35, the emitted setting signal of which serves as a desired value for a voltage regulator 36. From a voltage transformer 25 there is taken, as an actual value, a voltage $U_{G\ actual}$ proportional to the generator voltage and applied to the voltage regulator 36. The regulating signal $\Delta U_G$ is supplied to a circuit 37 which emits a setting signal $I_E$. The latter, which is proportionate to $\Delta U_G$, is applied to a field current rectifier 15 of the field winding 14 of the propulsion generator 12. In this manner the voltage is altered in the armature circuit of the propulsion generator 12 by means of the field current.

Using once again the example of actual value input of a propeller rpm of $n_{prop.actual}=0$, the difference between the desired value $n_{prop.desired}$ applied in advance by the engine order telegraph and $n_{prop.actual}=0$ means a high desired value input for the voltage regulator 36. Consequently, a large regulating signal is obtained. This means that the field current in the field winding 14 of the propulsion generator 12 is increased which, in turn, results in a voltage increase in the armature circuit of the propulsion generator. In this manner, the slippage in the propulsion motor 21 is altered towards a higher rotor rpm which, in turn, means an increase in the actual propeller rpm. Thus, there is obtained at the regulators 31 and 34 an increase of the actual value input. This affects the turbine rpm through the regulator 31 in such a manner that with a slow change, the turbine rpm also changes slowly and this change occurs above the critical output value, for example, towards $0.33n_{Tnom}$. The increase of the actual value input at the regulator 34 is compared with an again slowly increasing value of the desired value input from the engine order telegraph and the difference is again applied to the voltage regulator 36. In this manner, the armature voltage is affected in the propulsion generator circuit. The propulsion motor is continued to be driven in slip drive until the propeller rpm runs up to $0.33n_{prop.nom}$. The turbine rpm is then decreased, above the critical output limit value, from $0.66n_{Tnom}$ to $0.33n_{Tnom}$.

If the vessel is braked, the above-described regulation below the propeller rpm of $0.33n_{prop.actual}$ is effected in a reverse sense until the actual propeller rpm attains 0.

A reversal from forward run to reverse run may be effected by means of a propulsion reverser (not shown) by virture of a phase exchange in the armature circuit of the propulsion motor, whereby merely the direction of rotation is reversed.

The selection of a higher turbine rpm of, for example, $0.66n_{Tnom}$ makes possible during the propeller start a higher turbine output, so that the initial break-away torque at the propeller shaft is reliably applied. For a value of $n_T = 0.33N_{Tnom}$, the available output is $P = 0.5P_{nom}$, while for an rpm value of $n_T = 0.66n_{Tnom}$, the available output amounts to $P = 0.9P_{nom}$.

The above-discussed selection of the desired value input $n_T$ provides a substantial freedom for designing marine power plants of this type. Since, for redundancy reasons, very often the motor drive output is divided between two gas turbine generator sets into two halves, so that in case of a break-down of one aggregate, the remaining operational turbine is capable of driving the propulsion motor, it has to be ensured that in such an emergency situation the sole drive aggregate is capable to accelerate the propulsion motor from a standstill to its cruising rpm. In such a case the sole operational turbine has to furnish, at the beginning of the propeller start, approximately 90% of the nominal output value. It is further possible to so design marine power plants of this type that the motor drive output is not divided in a half-and-half ratio between the two gas turbine generator sets. In such an arrangement a main propulsion aggregate and an auxiliary propulsion aggregate of lesser output is provided, for example, for a "take-home operation", in case the main aggregate has broken down. In such a case, however, it is conceivable that in case the main propulsion aggregate breaks down during the starting of the motor, the auxiliary aggregate drops below the critical output limit and thus a starting of the motor becomes impossible.

Figure 4:
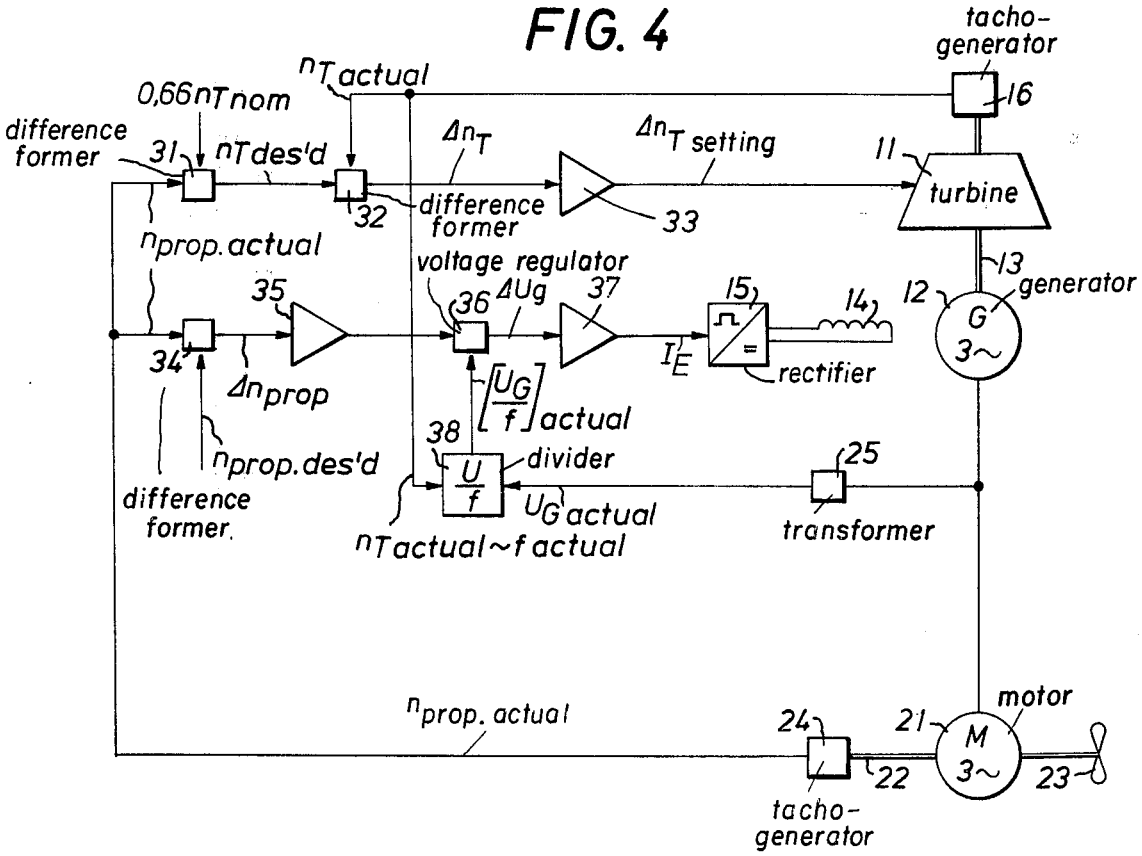
FIG. 4 is a block diagram of another preferred embodiment of a control circuit for the slip drive.

To remedy such a situation, a control circuit as illustrated in FIG. 4 may be used. In this case the regulating signal $\Delta n_{prop}$ of the desired propeller rpm and the actual propeller rpm are used as a desired value input for a voltage/frequency regulation. The actual value is obtained by forming the quotient of the actual turbine rpm (which is proportionate to the generator frequency) and the actual generator voltage value ($U_{G\ actual}/f_{G\ actual}$). Thus, at the voltage regulator 36 there appears, as the desired value, the regulating signal $\Delta n_{prop}$. The quotient forming apparatus 38 receives from the tacho-generator 16 the actual turbine rpm value and at the voltage transformer 25 there is obtained the actual generator voltage value. From these two values there is formed the quotient $U_{G\ actual}/f_{G\ actual}$ which is applied as the actual value signal $[u_{G/F}]$actual to the voltage regulator 36. If there is a danger of turbine stalling during the starting steps, that is, the rpm decreases towards a smaller value, the frequency value will drop. Consequently, the value of the quotient will be greater. This means that at the input of the voltage regulator 36 there appears a greater actual value input and for the regulator output there is obtained a smaller regulating signal which affects, through the field current rectifier 15, the field winding 14 of the propulsion generator 12. In this manner the field current is decreased and thus the voltage in the armature circuit also decreases. In the propulsion motor the slippage is altered in the sense of a smaller rotor rpm and thus load will be removed from the turbine.

It will be understood that the above description of the present invention is susceptible to various modifications, changes and adaptations, and the same are intended to be comprehended within the meaning and range of equivalents of the appended claims.

I claim:

1. In a method of regulating a turbo-electric marine power plant which has an rpm-regulatable heavy gas turbine constituting the prime mover of the power plant; a propulsion generator mechanically connected to the turbine; a propulsion motor electrically connected to the propulsion generator; a propeller shaft driven by the propulsion motor; a fixed propeller affixed to the propeller shaft; including the steps of controlling the speed by frequency regulation down to the minimum turbine rpm and controlling the speed by slippage regulation below the minimum turbine rpm; the improvement comprising the step of regulating the turbine rpm as a function of the propeller rpm to obtain a delivered turbine output which is above the minimum output limit of the turbine.

2. A method as defined in claim 1, further including the step of setting, in a slip drive, any propeller rpm from zero to an rpm corresponding to the minimum turbine rpm, by a voltage control as a function of the propeller rpm regulation.

3. A method as defined in claim 1, including the step of rotating the turbine, during the start of the propeller, with an rpm $n_{Tx}$ that is higher than an rpm on the minimum output curve of the turbine, while for the slip run the relationship $n_T = n_{Tx} - f(n_{prop.actual})$ applies.

4. In a method as defined in claim 3, wherein said relationship is $n_T$ [pus]$= 0.66 - n_{prop.actual}$[pus].

5. A method as defined in claim 2, including the step of regulating the voltage of the propulsion generator as a function of a desired value constituted by the regulating signal for the propeller rpm.

6. A method as defined in claim 5, including the steps of forming a quotient signal characterizing the ratio of the actual value of the propulsion generator voltage to the actual frequency value and regulating the voltage of the propulsion generator as a function of a further actual value, said further actual value being constituted by said quotient signal.

7. A control circuit for a turbo-electric marine power plant which has an rpm-regulatable heavy gas turbine constituting the prime mover of the power plant; a propulsion generator mechanically connected to the turbine and having a field winding; a propulsion motor electrically connected to the propulsion generator; a propeller shaft driven by the propulsion motor; and a fixed propeller affixed to the propeller shaft; comprising in combination:

a. first sensor means operatively connected to said turbine for responding to the actual turbine rpm and for emitting a first signal representing the actual turbine rpm;

b. second sensor means operatively connected to said propeller shaft for responding to the actual propeller rpm and for emitting a second signal representing the actual propeller rpm;

c. first regulator means operatively connected to said second sensor means for receiving said second signal and for emitting a third signal as a function of said second signal, said third signal representing the desired turbine rpm; and d. second regulator means operatively connected to said first sensor means and to said first regulator means for receiving said first and third signals, respectively; said second regulator means emitting a fourth signal as a function of said first and third signals, said fourth signal representing the turbine rpm regulating signal; said second regulator means being operatively connected to said turbine for regulating the turbine rpm as a function of said fourth signal.

8. A control circuit as defined in claim 7, further comprising e. third sensor means operatively connected to said propulsion generator for responding to the actual output voltage of said propulsion generator and for emitting a fifth signal representing the acual output voltage of said propulsion generator;

f. third regulator means connected to said second sensor means for receiving said second signal and for emitting a sixth signal as a function of said second signal; said sixth signal representing the propeller rpm regulating signal; and g. a voltage regulator operatively connected to said third regulator means and said third sensor means for receiving said fifth and sixth signals and for emitting a seventh signal as a function of said fifth and sixth signals; said seventh signal representing a voltage regulating signal;

i. said voltage regulator being operatively connected to said field winding for regulating the field current of said propulsion generator as a function of said seventh signal.

9. A regulator system as defined in claim 7, further comprising:

e. third sensor means operatively connected to said propulsion generator for responding to the actual output voltage of said propulsion generator and for emitting a fifth signal representing the actual output voltage of said propulsion generator;

f. ratio-forming means operatively connected to said first and third sensor means for receiving said first and fifth signals and for emitting a sixth signal representing the ratio of the actual output voltage of said propulsion generator to the frequency of said propulsion generator, g. third regulator means operatively connected to said second sensor means for receiving said second signal and for emitting a seventh signal as a function of said second signal; said seventh signal representing the propeller rpm regulating signal; and h. a voltage regulator operatively connected to said ratio-forming means and to said third regulator means for receiving said sixth and seventh signals and for emitting an eighth signal as a function of said sixth and seventh signals; said eighth signal representing a voltage regulating signal; said voltage regulator being operatively connected to said field winding for regulating the field current of said propulsion generator as a function of said eighth signal.

10. In a method of regulating a turbo-electric marine power plant which has an rpm-regulatable heavy gas turbine constituting the prime mover of the power plant; a propulsion generator mechanically connected to the turbine; a propulsion motor electrically connected to the propulsion generator; a propeller shaft driven by the propulsion motor; a fixed propeller affixed to the propeller shaft; including the steps of controlling the speed by frequency regulation down to the minimum turbine rpm and controlling the speed by slippage regulation below the minimum turbine rpm; the improvement comprising the steps of a. generating a first signal representing the actual turbine rpm;

b. generating a second signal representing the actual propeller rpm;

c. generating a third signal as a function of said second signal; said third signal representing the desired turbine rpm;

d. generating a fourth signal as a function of said first and third signals; said fourth signal representing the turbine rpm regulating signal; and e. applying said fourth signal as a setting signal to said turbine for regulating the turbine rpm as a function of the propeller rpm for obtaining a delivered turbine output which is above the minimum output limit of the turbine.

11. A method as defined in claim 10, further comprising the steps of f. generating a fifth signal representing the actual output voltage of said propulsion generator;

g. generating a sixth signal representing the desired propeller rpm;

h. generating a seventh signal as a function of said second and sixth signals; said seventh signal representing the propeller rpm regulating signal;

i. generating an eighth signal as a function of said fifth and seventh signals; said eighth signal representing the generator voltage output regulating signal; and j. applying said eighth signal to said field winding for regulating the field current of the propulsion generator for controlling the propeller rpm.

12. A method as defined in claim 10, further comprising the steps of f. generating a fifth signal representing the actual output voltage of said propulsion generator;

g. generating a sixth signal representing the desired propeller rpm;

h. generating a seventh signal as a function of the ratio of said fifth signal to said first signal;

i. generating an eighth signal as a function of said second and sixth signals; said eighth signal representing the propeller rpm regulating signal;

j. generating a ninth signal as a function of said seventh and eighth signals; said ninth signal representing the generator voltage output regulating signal; and k. applying said ninth signal to said field winding for regulating the field current of the propulsion generator for controlling the propeller rpm.

* * * * *

UNITED STATES PATENT AND TRADEMARK OFFICE

CERTIFICATE OF CORRECTION

PATENT NO. : 4,007,407

DATED : February 8th, 1977

INVENTOR(S) : Klaus Kranert

It is certified that error appears in the above-identified patent and that said Letters Patent are hereby corrected as shown below:

Column 1, line 37, change "econimical" to --economical--.

Column 2, line 46, change "the" first occurrence to --that--.

Column 3, line 36, delete the comma (,) before "31"; line 38, change "$n_{Tdes,d}$" to --$n_{Tdes'd}$--; line 44, change "comparision" to --comparison--; line 66, change "$\Delta n_T$" to --$\Delta n_{Tsetting}$--.

Column 4, line 8, change "$n_{prop\ des,d}$" to --$n_{prop\ des'd}$--; line 16, change "supplied" to --applied--; line 56, change "virture" to --virtue--; line 63, change "$0.33N_{Tnom}$" to --$0.33n_{Tnom}$--.

In Fig. 2 of the drawings, change the legend "delivered turbine output.... = $0,66n_{pr}$[pus]" to --delivered turbine output.... = $0.66\ -n_{pr}$[pus]--.

Signed and Sealed this

Seventh Day of June 1977

[SEAL]

*Attest:*

RUTH C. MASON
*Attesting Officer*

C. MARSHALL DANN
*Commissioner of Patents and Trademarks*